US006047415A

United States Patent [19]

Brown

[11] Patent Number: 6,047,415

[45] Date of Patent: Apr. 11, 2000

[54] POOL COVER

[76] Inventor: Ruth A. Brown, 1817 Schere Pkwy., St. Charles, Mo. 63303

[21] Appl. No.: 09/131,478

[22] Filed: Aug. 10, 1998

[51] Int. Cl.[7] ..... E04H 4/00

[52] U.S. Cl. ..... 4/498; 4/504

[58] Field of Search ..... 4/498, 503, 499, 4/500, 501, 502, 504

[56] References Cited

U.S. PATENT DOCUMENTS

| | | | |
|---|---|---|---|
| 3,683,428 | 8/1972 | Morris | 4/498 |
| 3,872,522 | 3/1975 | Bennett et al. | 4/498 |
| 5,067,182 | 11/1991 | Koelsch | 4/498 |
| 5,511,536 | 4/1996 | Bussey, Jr. et al. . | |
| 5,546,615 | 8/1996 | Chamness | 4/498 |

*Primary Examiner*—David J. Walczak
*Attorney, Agent, or Firm*—Polster, Lieder, Woodruff & Lucchesi L.C.

[57] ABSTRACT

A pool cover (C2) for use in a swimming pool (S) to inhibit algae growth and make the pool water more readily usable when the cover is removed. The cover includes single or multiple, interconnected panels (P) sized to fit within the confines of the pool, regardless of pool size and shape. Each panel comprises a multiple layer of material including upper and layers (L1, L2) of opaque material with a buoyant material (B) between these layers. Side panels (N) attach to the main portion of the cover to cover water surface areas (W, A, V) where people enter the pool, wade, or sit. The cover is used in conjunction with a cover (C1) fitted over the pool to protect the pool and people moving around the pool during those times of the year when the pool is not in use. The two covers are used together in a pool cover system.

8 Claims, 2 Drawing Sheets

POOL COVER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to pool covers used to protect swimming pools, and more particularly, to a free floating pool cover used in conjunction with a winter cover placed over the pool to protect it during the off-season and which protects inhibits algae growth in the water left in the pool during that period.

It is commonplace for swimming pool owners to install a cover over their swimming pool to protect the pool from leaves and other debris which would otherwise accumulate in the pool when it is not in use. Further, because the pool is typically not drained during the off-season, the pool cover prevents anyone around the pool from inadvertently falling into the pool. One type of pool cover which used is made of a mesh material which is strong enough to support someone's weight, and at the same time, allow any water which might fall onto the cover to drain through to the water below. Further, the cover design is such that if someone did fall upon it, it would prevent water from seeping through the cover in any quantity sufficient to drown the person.

In addition to this off-season cover, some pool owners employ another cover during the time the pool is in use. This cover is a free floating cover made of a thin, transparent material. This cover is floated on the top of the water when the pool is not in use to absorb heat energy from the sun and retain it in the pool water.

When the pool is taken out of use at the end of the swimming season, the pool water is usually heavily chlorinated. However, during the off-season, light from the sun shining either directly on the pool water, or through the winter cover, causes algae to grow in the pool water. As result, when it again time to use the pool, and the winter cover is removed, the water has an ugly green-black growth of algae which must be removed before the pool can be used. Such removal is both time consuming and expensive since the pool must again be chemically treated to kill off the algae and render the pool water safe for humans.

In U.S. Pat. No. 5,511,536 there is described a solar-type pool cover which is a multiple layer cover, in which an intermediate layer (16) is made of an opaque material and a reflective layer (17) are used to block sunlight from reaching the pool water and promoting algae growth. While such a pool cover construction may be effective for this and other intended purposes of the design, such a cover is costly, and difficult to install, remove, and store. The pool cover of the present invention provides a low cost, easy to install, and readily stowable cover which further can be adapted to a wide variety of pool configurations.

BRIEF SUMMARY OF THE INVENTION

Among the several objects of the present invention may be noted the provision of a free standing pool cover made of an opaque material that blocks passage of sunlight through the material so when the cover is installed on the surface of a swimming pool algae growth is inhibited;

the provision of such a pool cover which is used in conjunction with a cover installed over the pool during the off-season when the pool is not in use;

the provision of such a pool cover which is a free standing or free floating cover sized to fit within the confines of the pool and float atop the pool water without any type of attachment to the sides of the pool or the other pool cover;

the provision of such a pool cover which is made of a relatively thin multi-layer material that is opaque on both sides with a layer of a buoyant material sandwiched therebetween;

the provision of such a pool cover to be made in a plurality of interconnectable panels which, when fitted together, form a cover sized to fit the pool shape of the pool in which it is used, and when separated allow easy storage of the cover;

the provision of such a pool cover to further include side panels attachable to the main cover panels so to cover the area of a pool adjacent coves formed for steps, seating, and infants and small children;

the provision of such a pool cover which is readily made to fit standard pool sizes and shapes but which can also be custom made for use in custom shaped pools;

the provision of such a pool cover in which the buoyant material is protected from the chemicals used in the pool and which can attack the buoyant material and reduce the useful life of the cover;

the provision of such a pool cover which is easy to assemble, install, remove, and store;

the provision of such a pool cover which is a low cost cover; and, the provision of such a pool cover which effectively inhibits algae growth during use so when the cover is removed, the pool water is relatively clear and does not require extensive chemical treatment or clean-up before the pool can be used.

In accordance with the invention, generally stated, a pool cover is for use in a swimming pool so when in place the cover inhibits algae growth and makes the pool water made readily usable when the cover is removed. The cover is a free floating pool cover sized to fit within the confines of the pool, regardless of pool size and shape. The cover comprises a multiple layer of material including upper and layers of an opaque material, and a buoyant material between these two outer layers. The cover can either be of a single piece, or formed of interconnectable panels. Side panels are attachable to the main portion of the cover to cover water surface areas where people enter the pool, side coves, and play areas for infants and children. The cover is used in conjunction with a cover fitted over the pool to protect the pool and people moving around the pool during those times of the year when the pool is not in use. Other objects and features will be in part apparent and in part pointed out hereinafter.

BRIEF DESCRIPTION OF THE SEVERAL VIEWS OF THE DRAWINGS

In the drawings, FIGS. 1A–1C respectively illustrate different common shapes of swimming pools.

Corresponding reference characters indicate corresponding parts throughout the drawings.

DETAILED DESCRIPTION OF THE INVENTION

Figure 1A:
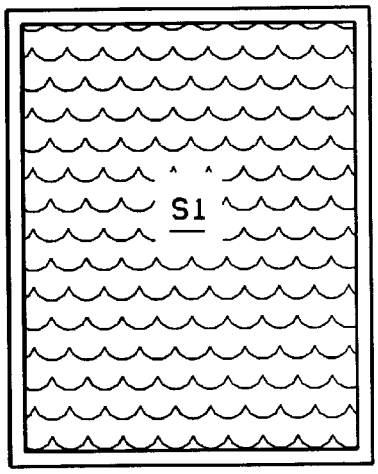
Figure 1C:
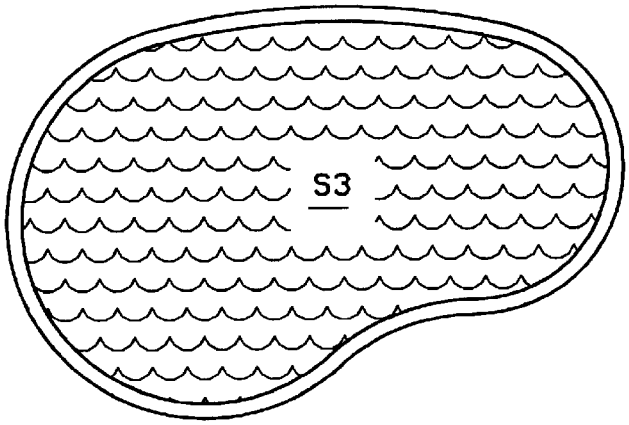
Figure 1B:
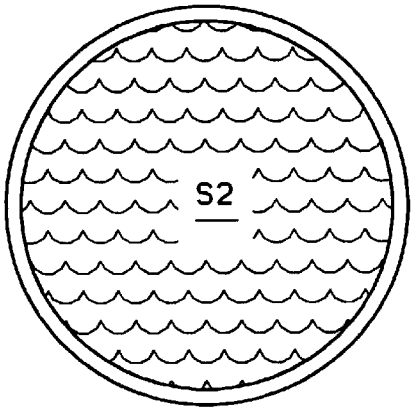
Figure 2:
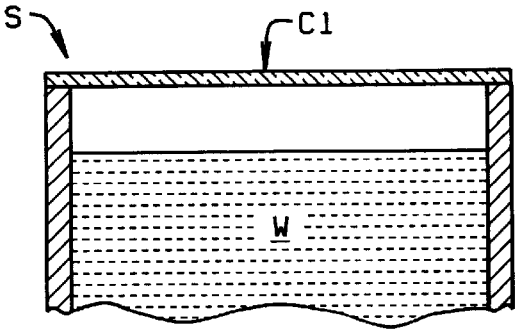
FIG. 2 PRIOR ART
FIG. 2 illustrates a prior art pool cover installation.

Referring to the drawings, swimming pools S1–S3 are shown in FIGS. 1A–1C. Pools S1 and S2 are of concential rectangular and oval shapes, whereas pool S3 represents a custom shaped pool. With any swimming pool S, there are periods during the year when the pool is not in use for prolonged intervals. In much of the country, swimming pool usage lasts from late spring through late summer or early autumn. During the rest of the year, the pool is not in use. As shown in FIG. 2, a pool cover C1 is installed over the pool to protect people from falling into the pool, and to prevent dirt, dust, and debris (leaves from trees, for example) from collecting in the pool on the surface of water W with which the pool is filled. The cover is typically of a transparent, mesh material which, while it prevents dirt, dust, and debris from falling into the pool, allows rain water, snow melt, etc. to drain into the pool. A disdavantage of such covers has been that the sunlight passing through the cover promotes algae growth such that when cover C1 is removed, the pool water, rather than being clear, has a dark, brackish appearance. This condition requires substantial treatment to clear up the water to where it is safe for humans to enter the pool.

Figure 3:
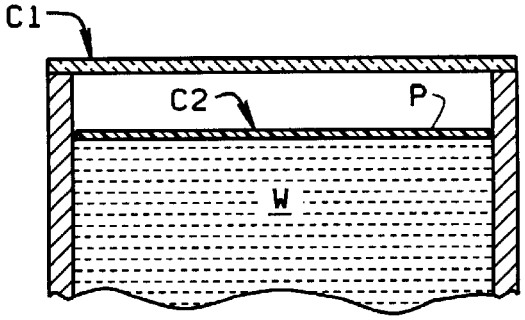
FIG. 3 illustrates a free floating pool cover installation of the present invention.
Figure 5:
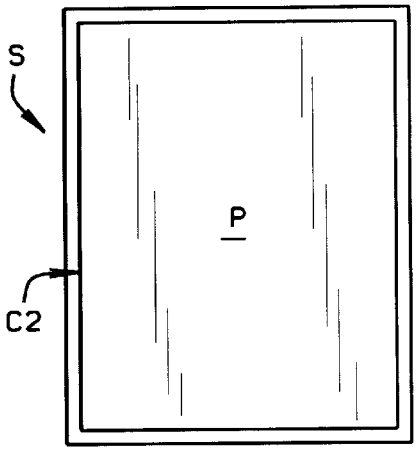
FIG. 5 illustrates a first embodiment of the pool cover installed in a pool.

Referring to FIG. 3, and in accordance with the present invention, A pool cover C2 is installable in a swimming pool S to prevent growth of algae in the pool. Cover C2 comprises an opaque, buoyant panel P sized to fit within the confines of the pool, the cover being a free standing or free floating cover which floats on top of the water with which the pool is filled. The panel is sized (as shown in FIG. 5) to substantially cover the surface area of the water and to closely fit against the sidewalls of the swimming pool. In the drawing FIGS., the separation between the edges of cover C2 and the pool sidewalls is exagerated for purposes of drawing clarity. Importantly, the cover prevents sunlight striking the cover from passing through the cover. This inhibits algae growth in the water so when cover C2 is removed, the water is either substantially or completely clear and requires little or no treatment before it can be used.

Figure 7:
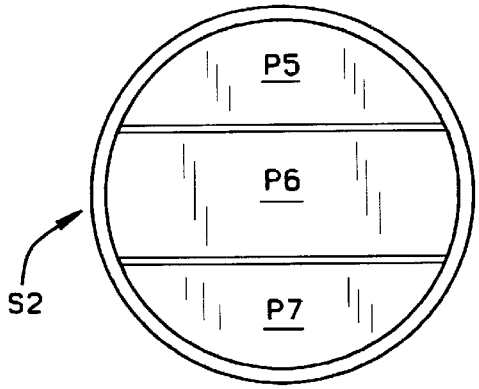
FIGS. 6 and 7 represent alternate second embodiment constructions of the pool cover also shown installed in a pool.
Figure 6:
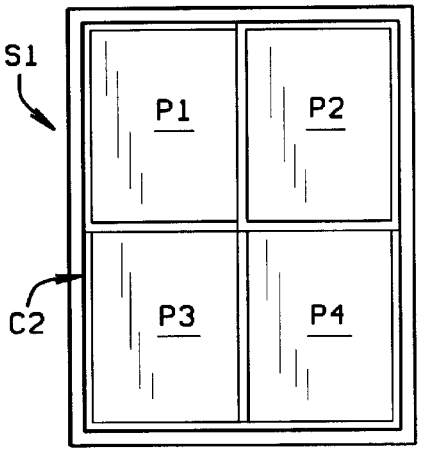
Figure 8:
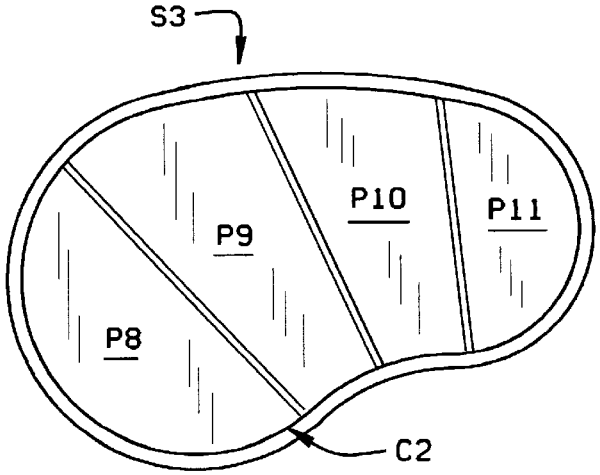
FIG. 8 illustrates how the pool cover of the present invention can be made to fit in a non-standard sized pool.

While, as shown in FIG. 5, pool cover C2 can comprise a single panel, as shown in FIGS. 6–8, the cover can also be formed of a plurality of interconnectable panels all of which float on top of the water in the pool. For larger pools, use of a cover C2 comprised of a plurality of panels makes it easier to store the cover when not in use. Thus, for the rectangular pool S1 of FIG. 6, four free floating, interconnected opaque panels P1–P4 are used to cover the pool. For the oval pool S2 of FIG. 7, three panels P5–P7 are used. For standard size pools, the size and shape of the panels are uniform. Thus, if a panel is tom or otherwise damaged, it can be easily replaced. For non-standard pool shapes, a cover C2 can also be made, although such a cover may have one or more custom panels depending upon the size and shape of the pool. Accordingly, for the custom shape pool S3 a cover C2 made of custom shaped panels P8–P11 can be made. With respect to attachment of the panels, snap together fittings F (see FIG. 4) or other convenient means of attachment are used. With fittings F, the fittings are spaced along each side of the panel and permit ready assembly and disassembly of cover C2 for installation or storage.

Figure 4:
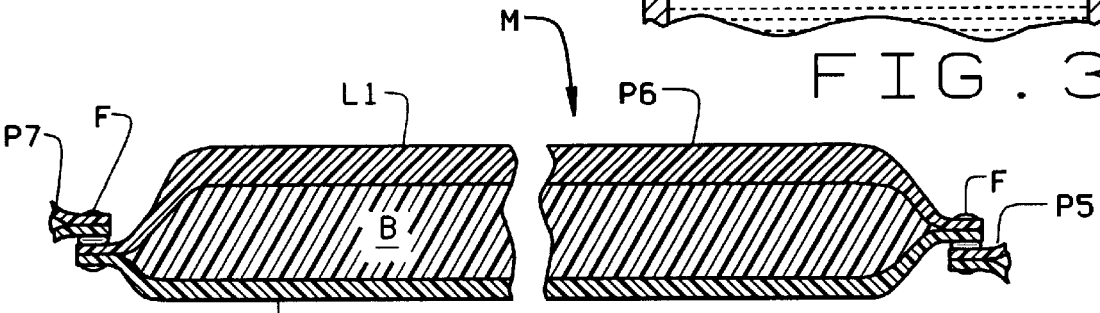
FIG. 4 is a cross sectional view of the pool cover.

Regardless of whether made of a single or multiple panels, each panel comprises a multilayer material M as shown in FIG. 4. The material has first and second opaque outer layers L1, L2, with a layer of a buoyant material B sandwiched between these opaque outer layers. Besides preventing passage of sunlight through cover C2 into the water, the outer layers further protect the buoyant material from chemicals such as chlorine with which water is treated. These chemicals, over time, attack and destroy the buoyant material B correspondingly shortening the service life of cover C2.

Figure 9:
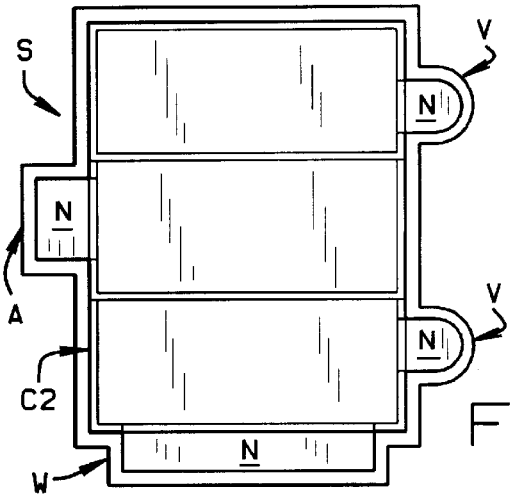
FIG. 9 illustrates the pool cover with side panels attached thereto to cover pool areas formed at the sides and end of a pool.

Referring to FIG. 9, many swimming pools, in addition to their main portion, also have adjacent pool sections. These include, for example, a wading pool area W for small children, seating alcoves V where people can sit and read while partially immersed in the water, and-and a pool access area A including steps (not shown) for entering and leaving the pool. If these areas are not covered by cover C2; then, even though the main portion of the pool may be covered, enough sunlight can reach the water in these unprotected areas to still promote substantial algae growth. Cover C2 includes one or more side panels N, as appropriate, to cover these areas. Each panel is appropriately shaped for the areas it covers. Each panel is connectable to a side of of panel P or one of the panels comprising cover C2 so to cover the portion of the pool adjacent the main portion thereof. Again, fittings such as the snap fittings F of FIG. 4 are on the sides of the panel or panels adjacent the pool sidewalls, as well as along the one side of the panels N attached to cover C2.

Finally, pool covers C1 and C2 can be used together as a system for protecting the pool when not in use. Cover C2 is placed in its free floating position on top of the pool water. Cover C1 is next placed over the pool so the arrangement shown in FIG. 3 is completed. As previously noted, cover C1 keeps people from falling into the pool and particles out of the water. However, cover C1 does allow sunlight through. Cover C2 with its opaque, buoyant panels, blocks the sunlight from reaching the water so algae will not grow in the water while the cover system is in place.

What has been described is a free standing pool cover formed of opaque material to block passage of sunlight so when the cover is installed on the surface of a swimming pool, algae otherwise promoted by sunlight is inhibited. Use of the pool cover effectively inhibits algae growth so when the cover is removed, the pool water is relatively clear and does not require extensive chemical treatment or clean-up before the pool can be used. The pool cover is installed in conjunction with a cover installed over the pool when the pool is not in use. The pool cover fits within the confines of the pool and floats atop the pool water without attachment to the sides of the pool or the other pool cover. The cover is of a thin multi-layer material opaque on both sides and with a layer of buoyant material sandwiched therebetween. The cover can be single piece or made of a plurality of interconnectable panels which, when separated, permits easy storage of the cover. Side panels are attachable to the cover to cover the area of a pool adjacent steps; seating coves, and wading areas. The pool cover fits standard sized pools but can also be custom made for custom shaped pools. The cover is easy to install, remove, and store.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A pool cover for installation in a swimming pool to prevent growth of algae in the pool, the pool cover comprising a plurality of interconnectable opaque, buoyant panels sized to fit within the confines of the pool and freely float on top of water with which the swimming pool is filled, the panels, when connected together, substantially covering the surface area of the water to prevent sunlight striking the cover from passing through the cover so to inhibit algae growth in the water, each panel having fittings thereon for interconnecting the panel with adjacent panels, said panels being readily attachable and detachable using said fittings, and the edges of one panel overlapping with the edges of an adjacent panel to which said one panel is attached, each panel further comprising a multi-layer material, said material having first and second opaque outer layers and a buoyant material sandwiched between said opaque outer layers, said outer layers being material resistant to chemicals in the water which attack and destroy the buoyant material and shorten the service life of the cover, said pool cover being for use with a mesh-type cover fitted over the pool for protecting the pool when the pool is not in use, said pool cover being unconnected to said mesh-type cover.

2. The pool cover of claim 1 wherein one of said panels is sized to substantially cover the surface area of the water.

3. The pool cover of claim 1 further including at least one side panel connectable to a side of said pool cover to cover a portion of the pool adjacent a main portion thereof, said portion being for a wading pool, seating alcove, or steps for entering and leaving the pool, said side panel also having fittings thereon for interconnecting the side panel with said pool cover, said side panel being readily attachable and detachable using said fittings, and the edge of said side panel overlapping an edge of said pool cover to which said side panel is attached.

4. A system for protecting a swimming pool during prolonged periods when the pool is not in use, the system preventing harm to people who may be around the pool when the pool is not in use, and the system inhibiting algae growth in pool water with which the pool is filled during the pool's period of non-use, the system comprising:

a first pool cover which fits completely over the pool and prevents people, dirt, dust, and debris from falling into the pool; and, a second pool cover sized to fit within the confines of the pool and freely float on top of the water, said second pool cover being sized to substantially cover the surface area of the water and prevent sunlight striking the second cover from passing through the cover so to inhibit algae growth in the water, said second pool cover comprising a plurality of interconnectable opaque, buoyant panels sized to fit within the confines of the pool, the panels, when connected together, substantially covering the surface area of the water, each panel having fittings thereon for interconnecting the panel with adjacent panels, said panels being readily attachable and detachable using said fittings, and the edges of one panel overlapping with the edges of an adjacent panel to which said one panel is attached.

5. The system of claim 4 wherein said second pool cover comprises a single panel sized to substantially cover the surface area of the water.

6. The system of claim 4 wherein each panel comprising said second pool cover comprises a multi-layer material having first and second opaque outer layers and a buoyant material sandwiched between said opaque outer layers, said outer layers protecting the buoyant material from chemicals in the water which could attack and destroy the buoyant material and shorten the service life of the cover.

7. The system of claim 4 further including at least one side panel connectable to a side of said second pool cover to cover a portion of the pool adjacent a main portion thereof, said portion being for a wading pool, seating alcove, or steps for entering and leaving the pool, said side panel also having fittings thereon for interconnecting the side panel with said second pool cover, said side panel being readily attachable and detachable using said fittings, and the edge of said side panel overlapping an edge of said pool second cover to which said side panel is attached.

8. The system of claim 4 wherein said first pool cover is of an open mesh material sufficiently strong to support the weight of a person, the open mesh allowing water to drain through said first cover into the pool.

* * * * *